United States Patent [19]

Gryctko

[11] 4,011,425

[45] Mar. 8, 1977

[54] ARC CHUTE EXTENSION FOR INCREASED INTERRUPTION RATING

[75] Inventor: Carl E. Gryctko, Haddon Heights, N.J.

[73] Assignee: I-T-E Imperial Corporation, Spring House, Pa.

[22] Filed: Jan. 3, 1975

[21] Appl. No.: 538,342

[52] U.S. Cl. ..... 200/144 R; 200/146 R; 200/148 C

[51] Int. Cl.[2] ..... H01H 9/36

[58] Field of Search ..... 200/289, 306, 146 R, 200/148 C, 144 R, 144 B, 144 C, 147 C

[56] References Cited

UNITED STATES PATENTS

| | | | |
|---|---|---|---|
| 1,784,760 | 12/1930 | Slepian | 200/144 R |
| 2,293,513 | 8/1942 | Linde | 200/144 R |
| 3,025,376 | 3/1962 | Yarrick | 200/148 C |
| 3,582,966 | 6/1971 | Strobel | 200/144 R |
| 3,740,510 | 6/1973 | Grunert | 200/144 R |
| 3,784,775 | 1/1974 | Gryctko | 200/146 R |
| 3,803,376 | 4/1974 | Gryctko | 200/144 R |

FOREIGN PATENTS OR APPLICATIONS

| | | | |
|---|---|---|---|
| 1,068,436 | 5/1967 | United Kingdom | 200/144 R |

*Primary Examiner*—Gerald P. Tolin
*Attorney, Agent, or Firm*—Ostrolenk, Faber, Gerb & Soffen

[57] ABSTRACT

A molded case circuit breaker having a spaced plate arc chute for each pole thereof, with each arc chute having a V-shaped mouth region at one end and having separable arcing contacts positioned at the mouth region and having a space defined opposite the mouth region and between a cover plate region and a terminal bus for obtaining access to terminal mounting bolts, is provided with at least one arc chute extension attached to a cover panel portion. Each arc chute extension consists of a plurality of spaced conductive plates and insulated means for rigidly positioning each of the plates in close planar alignment with a plate of the arc chute to present an increased length serpentine path for extinguishing an arc produced by the interruption of voltages and currents in excess of the original arc chute rating. Arc chute extensions are introduced as a single unit to increase the interruption rating of as many poles of the circuit breaker as is required.

9 Claims, 4 Drawing Figures

ARC CHUTE EXTENSION FOR INCREASED INTERRUPTION RATING

BACKGROUND OF THE INVENTION

This invention relates to molded case circuit breakers in general and more particularly relates to novel means for selectively increasing the interruption rating of one or more poles of a molded case circuit breaker.

Molded case circuit breakers often utilize a spaced plate type arc chute to receive and extinguish arcs generated during current interruption. The conductive plates of the arc chute serve to provide a series of barriers to the uniform outward expansion of an interruption arc in a direction away from the opening contacts. A serpentine-shaped arc results, as the arc may only expand into those areas between the spaced plates. This serpentine path causes rapid extinguishment as the arc travels into regions where the spaces between the plates of the arc chute become wider and the arc pressure is insufficient for the arc to bridge the increasing gap.

When a circuit breaker of the above described type is provided with bolted line terminal connections, it is desirable that the terminal mounting bolts be accessible from the front of the circuit breaker, so that the circuit breaker can be installed or removed from the front of a switchboard. Large current capacity breakers, in the range above 1000 amperes, utilize line terminals which require considerable mounting area. The volume above this area cannot be permanently filled with any other circuit breaker component if the terminal mounting bolts are to be accessible. The volume contained in front of these terminal areas is normally empty and wasted.

Most molded case circuit breakers are utilized at voltages which range between 120 volts and 480 volts. The remaining use of such molded case circuit breakers is generally at voltages in the region of 600 volts. As the voltage rises, the circuit breaker requires different and generally larger arc extinguishing structures.

One possible approach toward manufacturing a general purpose circuit breaker might be to design the breaker for use at 600 volts. When the breaker is used at voltages below 600 volts, a significant part of the arc structure is not required and its presence is economically and physically undesirable. Similarly, a circuit breaker designed to interrupt a particular maximum flow of current will have an increased current interrupting capacity from the addition of a larger arc chute in which de-ionization and proper quenching of the arc can take place. A circuit breaker designed to handle very large flows of current would also have a portion of its arc chute become unnecessary if subsequently used for lower current applications.

It is desirable to design and manufacture one basic circuit breaker which will handle moderate voltage and moderate current requirements, e.g. a voltage of 240V., a current of 10,000A., and then to provide for the installation of additional simple components to obtain a higher interruption rating. Existing compact circuit breaker contact structures, such as are described in my U.S. Pat. No. 3,770,992, and in U.S. Pat. No. 3,755,638, to Lucas and Huggins, will interrupt these wide ranges of voltages and currents. It has been found that the same type of contact structure may be utilized in a basic circuit breaker and obviate the necessity for replacement to increase the interruption rating somewhat. Similarly, it is known to provide a venting control, such as shown in my U.S. Pat. No. 3,803,376, to prevent flashover and to de-ionize arc products over an equally wide range of voltages and currents without requiring replacement to increase the interruption rating. However, an arc chute which is adequate at medium values becomes inadequate at higher values of voltage and current.

It is desired to selectively add a larger arc chute structure at the site of installation to meet higher voltage and current requirements than provided for by the basic circuit breaker, while still maintaining access to the line terminal mounting bolts. This larger arc chute would not be installed in circuit breakers whose voltage and current usage does not require the increased interruption ratings. This will result in a saving of material and manufacturing cost for the arc chute structure and will obviate the need to tool for several different interruption ratings for the same circuit breaker configuration.

SUMMARY OF THE INVENTION

To selectively increase the interruption rating of a molded case circuit breaker having a spaced plate arc chute while maintaining access to the line terminal mounting bolts, in accordance with the invention there is an arc chute extension having a plurality of conductive plates, each of which is in close planar alignment and abutting end to end relationship with a plate of the existing arc chute structure. Each plate of the arc chute extension is rigidly fastened to an insulated frame at the plate edges transverse to the direction of plate extension. The insulated frame is attached to a cover plate portion which fits into the circuit breaker case directly over the line terminal mounting bolts. The frame includes an insulating portion interposed to be between the line terminal mounting bolts and the conductive plate spaced furthest away from the cover portion, so as to prevent an arc being drawn to the terminal bus. A vent, to cool and de-ionize arcing products exhausted from the arc chute extension, is attached to the frame in proximity to the conducting plate ends furthest from the interrupter contact region.

The arc chute extension just described has the advantage that it permits increasing the interruption rating of at least one pole of the circuit breaker while maintaining cover plate integrity for safety reasons and still allowing access to the line terminal mounting bolts when the arc chute extension is removed from the cover plate of the circuit breaker.

Accordingly, it is a primary object of the present invention to provide a means for selectively increasing the interruption rating of at least one pole of a circuit breaker.

It is another object of the present invention to provide such means for selectively increasing the interruption rating of at least one pole of a circuit breaker while allowing access through the cover plate to the line terminal mounting bolts.

It is a further object of the present invention to provide such means for selectively increasing the interruption rating of at least one pole of a circuit breaker while preventing both the formation of an arc to the line terminal and a flashover within such means.

These as well as other objects of the invention will become apparent from the following description of the accompanying drawings.

DETAILED DESCRIPTION OF THE INVENTION

Figure 2:
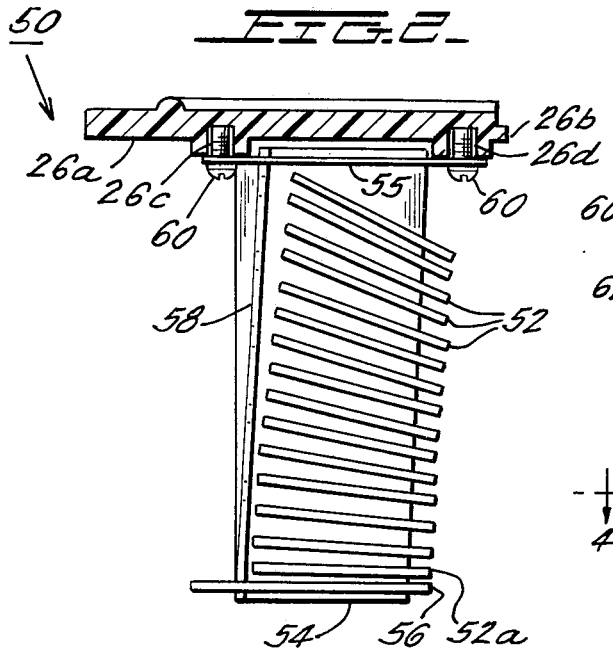
FIG. 2 is a cross-sectional view in side elevation of the arc chute extension in accordance with the invention, along the line and in the direction of arrows 2—2 in FIG. 1.
Figure 1:
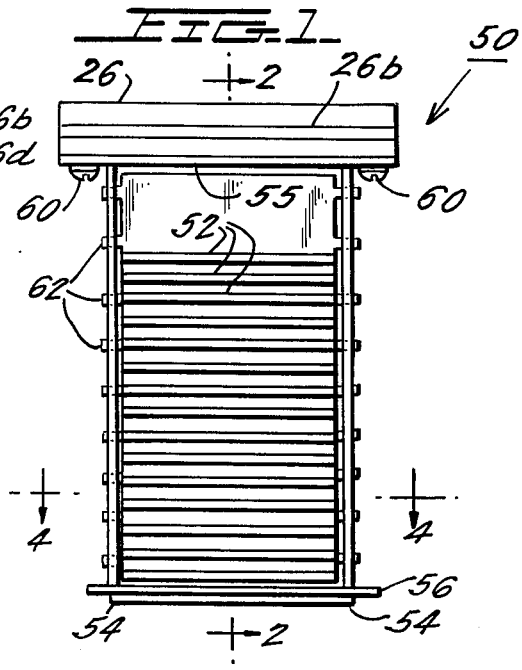
FIG. 1 is an end view of an arc chute extension in accordance with the invention.
Figure 3:
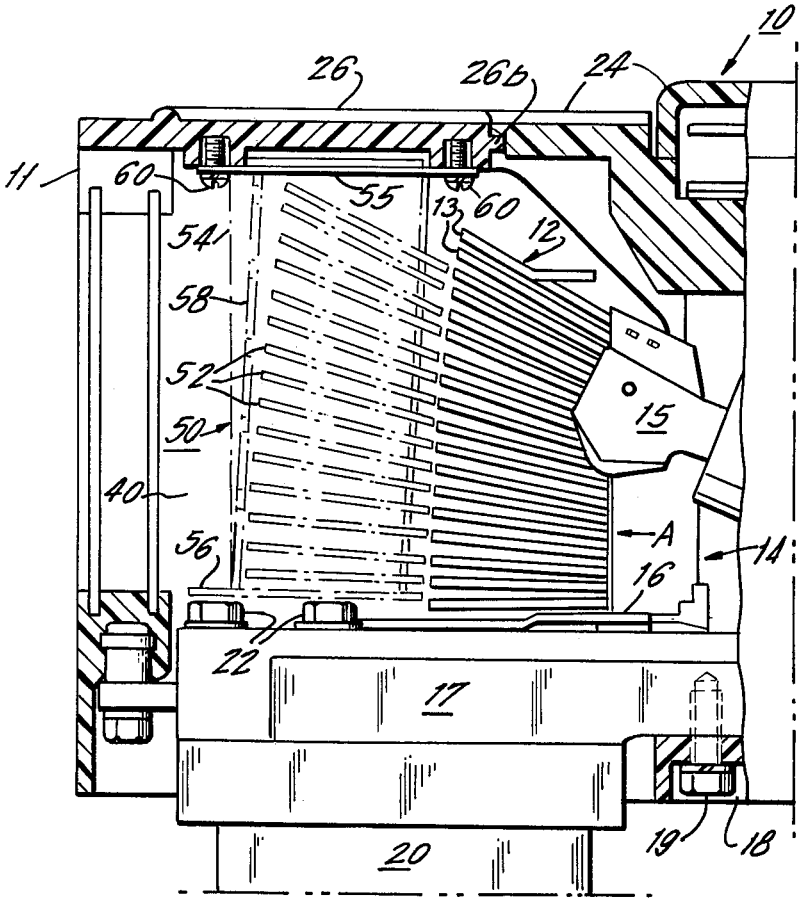
FIG. 3 is a partially-sectional view in side elevation of the arc chute extension in accordance with the invention and the surrounding elements of the circuit breaker in which it is used.
Figure 4:
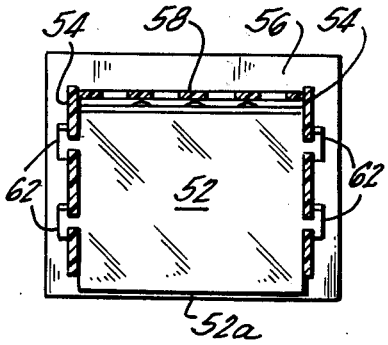
FIG. 4 is a plan view of a cross-section of the arc chute extension in accordance with the invention along the line and in the direction of arrows 4—4 in FIG. 1.

Referring to FIG. 3 of the drawings, molded case circuit breaker 10 includes an arc chute 12 for each pole. The arc chute is composed of a stack of spaced plates 13. Each plate has a V-shaped mouth region at one end thereof (not shown in the interest of simplicity). A contacting structure 14, which includes a movable contact 15 and a stationary contact 16, is positioned at this mouth region. The stationary contact 16 is connected to a terminal bus 17 which is securely fastened against the circuit breaker 18 by at least one threaded bolt 19. The entire circuit breaker is mounted to the line terminals 20 by means of line terminal mounting bolts 22 which pass through passages in the terminal bus 17 and are threadably engaged in tapped apertures (not shown in the interest of simplicity) in the line terminal 20. A cover plate 24 forms the front side of the circuit breaker and serves both to prevent harmful matter from entering the circuit breaker mechanism and to prevent the presence of a personnel shock hazard. A portion 26 of the cover plate 24 is independently demountable from the structure of the circuit breaker 10. Removal of this cover plate portion 26 provides access to the line terminal mounting bolts 22 through interior space 40, which is between the circuit breaker case and the ends of the arc chute plates opposite the plate mouth region.

Commonly used circuit breakers may, dependent upon the power line configuration to be interrupted, contain 1, 2, or 3 poles. Each pole requires a contacting structure 14, an arc chute 12 and a terminal bus 17. Thus, in a three pole circuit breaker, the depth of space 40, in a direction along the end plane of spaced plates 13, will be at least three times as great as the corresponding dimension in a single pole circuit breaker. The resulting large volume of space 40 must be empty of any circuit breaker component during installation.

The circuit breaker is installed by removing the cover plate portion 26 and introducing the proper tool into space 40 to securely engage the line terminal mounting bolts 22 for each pole through the passages in a terminal bus 17 and into the cooperating apertures in a line terminal 20.

In operation, the separation of the contacts 15 and 16 interrupts the current flow and causes a plasma arc to be drawn therebetween. The strength of the arc increases as the magnitude of the voltage and current being interrupted increases. The arc generates a magnetic force which causes the arc to expand toward the plates 13 of the arc chute 12 (direction indicated by arrow A). The arc assumes a serpentine shape as it expands into the spaces between each adjacent pair of plates. The plates are so positioned that the spaces therebetween are continuously increasing. The arc extends into these spaces until a plate separation is reached at which the arc strength becomes insufficient to maintain the plasma and the arc breaks and is extinguished. The length of the plates 13 must be sufficiently long to allow this arc quenching process to occur before the arc reaches the ends of the plates opposite the contacting structure 14 or the arc will flashover from plate to plate. The plasma quenching process produces ionized gases which exit from the arc chute at the end having maximum plate spacing.

One general circuit breaker is constructed to interrupt a wide range of voltages and currents. The basic structure incorporates an arc chute for one range of voltages, preferably 120–240 volts, and one maximum flow of current, preferably 10,000 Amperes. The basic unit is designed to always provide an empty interior space 40 for line terminal mounting bolt access.

Referring now to all the drawings, the basic circuit breaker pole interrupting rating is increased to a voltage of 600 volts or a current flow of 65,000 Amperes by the extension of the basic arc chute 12. Compact contact structures 14 are known which are usable over this entire range of voltages and currents and which may be initially installed in the basic circuit breaker.

In accordance with the invention, the arc chute extension comprises a plurality of spaced conductive plates 52 rigidly stack positioned by insulated frame arms (54—54) whereby each plate is in planar alignment with the plane of a plate 13 of the arc chute 12. The frame arms are attached to an insulated frame cross-portion 55 which is fastened to a cover plate portion 26 for positioning the arc chute extension 50 in close proximity to the arc chute 12 and completely within the interior chamber 40.

The extension of the basic unit arc chute 12 must be accomplished by the lengthening of the arc chute plates 13 while forming a flat plane with both plate surfaces. The extension plates 52 must be closely positioned to the more widely spaced ends of the basic arc chute plates and continue to increase the plate-to-plate distance. These conditions allow a denser arc to expand more deeply into the extended arc chute and to be properly quenched as the arc travels along the resulting longer path.

In the preferred embodiment of the invention, an insulating cover plate portion 26 is formed to extend the cover plate 24 over the chamber 40. The cover plate portion is provided with formations **26*a* and 26*b* near the edges thereof to facilitate fastening the cover plate portion to the existing structure 11 and/or cover plate 24 of the circuit breaker. A frame cross-portion 55 of insulating material is attached by fastening means 60 to formations 26*c* and 26*d* in the interior surface of the cover portion. A pair of parallel spaced arms (54—54) of insulating material extend perpendicularly from the vicinity of the opposite edges of the cross-portion 55. A number of spaced plates 52 having a plurality of tabs 62 extending from each side are positioned between the arms at intervals to be in the same plane and in proximity with the arc chute plates when the arc chute extension is installed in the circuit breaker. The plates are secured by introducing the tabs through apertures in each arm and then twisting the portion of each tab which extends beyond the outer surface of each arm whereby the tab cannot be removed from the aperture. A member 56 of insulating material is attached between the free ends of arms 54—54, to provide an insulated barrier between the plate 52***a* furthest from the cover portion 26 and the terminal bus 17. Known venting control means 58 is attached between the arms 54—54 near the wider spaced end of the plates to cool and de-ionize exhaust gases to prevent flashover between the plates.

One of the frame-plate assemblies is attached to the cover portion in a position aligned with the arc chute of each of the poles whose interruption rating is to be increased. Thus, the basic circuit breaker 10, without a cover portion 26, is attached to the line terminals 20 by the line terminal mounting bolts 22 being manipulated by a tool inserted into space 40. If an increased interruption rating is not required for any pole of the circuit breaker, a blank cover portion is fastened to the cover plate to enclose the interior space. If a number of poles require an increased interruption rating, arc chute extension stacks are fastened to the cover portion 26 in a position corresponding to the desired poles. The complete arc chute extension 50 is inserted in space 40 and the cover portion 26 is fastened to the structure 11 and cover plate 24 of the circuit breaker to complete the installation of the increased interruption rating circuit breaker.

There has just been described a novel arc chute extension for increasing the interruption rating of at least one pole of a circuit breaker, wherein the plates of the arc chute are further extended and spaced to cause the extinguishment of an interruption arc, while allowing access to the line terminal mounting bolts of the circuit breaker. Even though arc chute extension 50 has been described as being secured to cover portion 26 by screws 60, it should now be apparent to those skilled in the art of molded case circuit breakers that extension 50 and portion 26 need not be secured together as a subassembly. In the latter event, extension 50 will be dropped into place and then retained by cover portion 26 as the latter is secured to the circuit breaker housing.

Although there has been described a preferred embodiment of this novel invention, many variations and modifications will now be apparent to those skilled in the art. Therefore, this invention is to be limited not by the specific disclosure herein, but ony by the appending claims.

The embodiments of the invention in which an exclusive property or privilege is claimed are defined as follows:

1. A circuit breaker including an insulating case having removable cover means; a terminal bus; a pole unit within said case including separable cooperating movable and stationary contacts, said stationary contact being mounted to said bus at one end and in front thereof; a main spaced-plate arc chute having an entrance end operatively positioned at said one end of said bus to receive electric current arcs drawn between said contacts during separation thereof; a chamber within said case positioned forward of said bus at the other end thereof; securing means for maintaining said circuit breaker in electrical connection with an external circuit, said securing means being accessible for operation within said chamber; and a spaced-plate arc chute extension disposed within said chamber to receive portions of electric current arcs extending through said main arc chute, said arc chute extension being removably mounted within said chamber in front of said securing means for access to said securing means without the necessity of moving said main arc chute.

2. A circuit breaker as set forth in claim 1 further including insulated positioning means rigidly stack-positioning said arc plates of said arc chute extension.

3. A circuit breaker as set forth in claim 2 in which the removable cover means includes a separably demountable cover portion extended across said chamber, said insulated positioning means being secured to said demountable cover portion.

4. A circuit breaker as set forth in claim 3 in which the demountable cover portion further comprises a plate of insulating material having formations in the vicinity of the edges thereof to facilitate fastening said plate to said insulating case in flush alignment with the exterior surface of said removable cover means and having formations on the interior surface of said plate to facilitate attaching said insulating positioning means thereto.

5. A circuit breaker as set forth in claim 4, further including venting control means for cooling and de-ionizing gases exhausted from said arc plates of said arc chute extension, said venting control means being attached to said insulating means and being positioned opposite the aligned ends of said arc plates.

6. A circuit breaker as set forth in claim 4, in which the insulating positioning means includes a plurality of spaced sheets of an insulating material attached in a generally perpendicular direction to said sheets; first means fastening said sheets to said arc plates of said extension and interposed therebetween; and second means fastening said connecting member to the interior surface of said demountable cover portion.

7. A circuit breaker as set forth in claim 4, in which the insulating positioning means includes a frame of insulating material having a generally U-shaped cross-section with arms spaced to closely receive said arc plates of said extension therebetween and having a plurality of apertures therethrough in alignment with the plane of said arc plates and having a cross-portion at one end thereof and extended between the one end of said arms; first means fastening said arc plates of said extension through said arm apertures; second means fastening said cross-portion against the interior surface of said cover portion and cooperating with said interior surface formations therein; and a member of insulating material extended between the free ends of said arms, whereby the arc plate furtherst from said cover portion is prevented from contacting said securing means.

8. A circuit breaker as set forth in claim 1 in which the arc chute extension includes a plurality of arc plates each of which is positioned in close generally planar alignment with a different arc plate of said main arc chute, each of said arc plates of said arc chute extension being spaced from said bus by different distances measured forward from said bus and each of said arc plates of said main arc chute being spaced from said bus by different distances measured forward from said bus.

9. A circuit breaker as set forth in claim 8, in which the removable cover means includes a separably demountable cover portion extended across said chamber, said arc chute extension being secured to said cover portion so as to be removed from said chamber by demounting said cover portion.

* * * * *